United States Patent [19]

Hamilton

[11] 4,194,271

[45] Mar. 25, 1980

[54] APPARATUS FOR RELEASABLY RETAINING ARTICLES IN POCKETS AND THE LIKE

[76] Inventor: Cecil E. Hamilton, 209 W. Lincoln Hwy., New Haven, Ind. 46774

[21] Appl. No.: 901,128

[22] Filed: Apr. 28, 1978

[51] Int. Cl.[2] ..... A44B 21/00

[52] U.S. Cl. ..... 24/3 R; 24/3 H; 24/3 J; 150/47

[58] Field of Search ..... 24/3 H; 150/47

[56] References Cited

U.S. PATENT DOCUMENTS

| | | | |
|---|---|---|---|
| 921,775 | 5/1909 | Wilson | 150/47 |
| 1,172,482 | 2/1916 | Perkins | 24/3 H |
| 1,610,382 | 12/1926 | Jeffries | 150/47 |
| 2,129,018 | 9/1938 | Martini | 24/3 H |
| 2,574,023 | 11/1951 | Du Fault | 24/3 H |
| 3,760,459 | 9/1973 | Miles | 24/3 H |

*Primary Examiner*—Victor N. Sakran
*Attorney, Agent, or Firm*—Gust, Irish, Jeffers & Hoffman

[57] ABSTRACT

A plate-like housing is adapted to be secured to a wallet, or other pocket-sized valuable, and has formed therein a channel which is substantially transverse to the direction of the article or valuable withdrawal from a clothing pocket, or the like. A pair of slides are reciprocably movable in the channel and are spring-urged outwardly from the article in a transverse direction so that the slide ends are engageable with opposite sides of the pocket confines when the slides are in their extended or outermost positions. The respective ends of the slides each carry a pivotally mounted wing which cammingly engage the opposite sides of the pocket confines, thus increasing the slide dimension in the transverse direction, upon attempted withdrawal of the article from the pocket. The slides are releasably retainable in an inner position, substantially within the confines of the channel, when predetermined segments of the respective ends of the slide are manually compressed, but are not so retained when the manual force is applied to any of the remaining segments of the respective ends of the slide so that the slides are retained only upon manual force being applied to the particular predetermined segment, known only to the wearer, effectively foiling any pick-pocket attempt.

11 Claims, 12 Drawing Figures

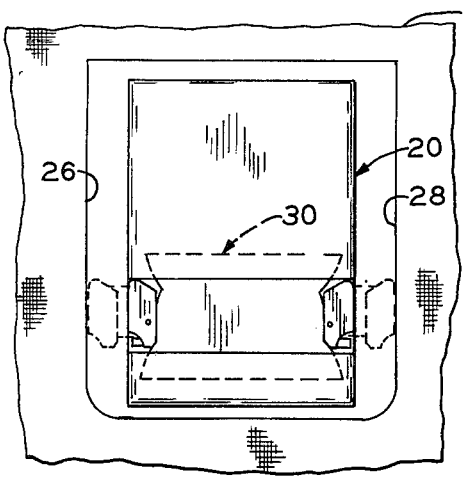
FIG. 1
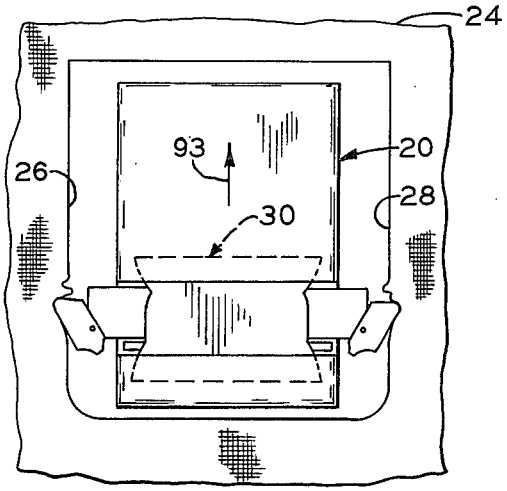
FIG. 2
FIG. 3a
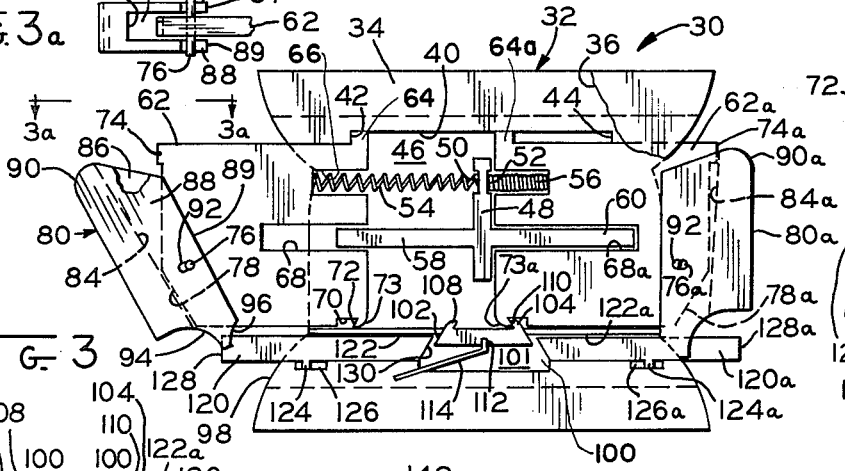
FIG. 3
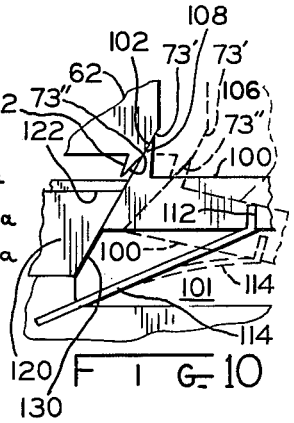
FIG. 10
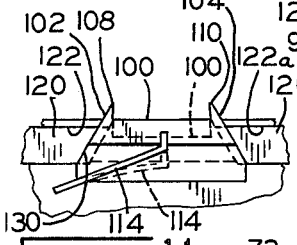
FIG. 11
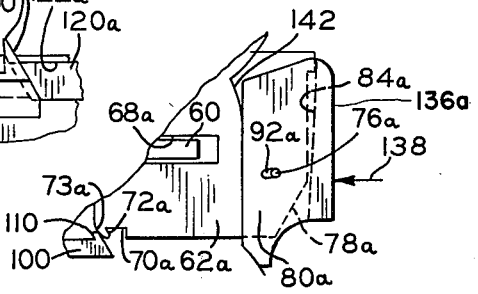
FIG. 4
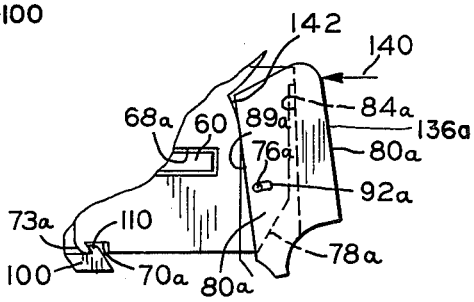
FIG. 5
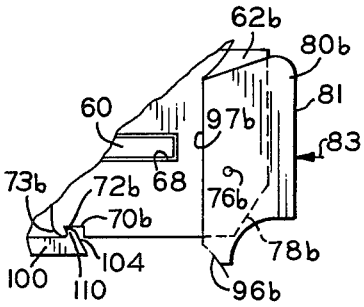
FIG. 6
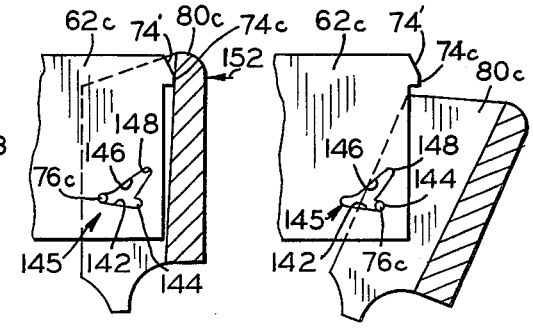
FIG. 7 FIG. 8
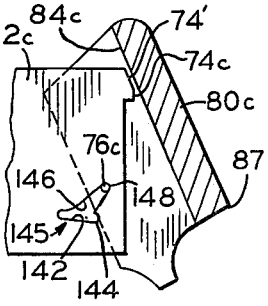
FIG. 9

APPARATUS FOR RELEASABLY RETAINING ARTICLES IN POCKETS AND THE LIKE

BACKGROUND OF THE INVENTION

1. Field of the Invention

This invention is in the field of devices for releasably retaining articles in pockets and the like and more particularly to those devices which are adapted for attachment to wallets to prevent removal of the wallet from the confines of a pocket by a thief or "pick-pocket" and which prevents the accidental or inadvertent falling of the wallet from the pocket when the pocket opening is inverted as might occur during undressing of the wearer.

2. Description of the Prior Art

Devices attachable to pocket-books, wallets, and other pocket size articles of value for pocket retention of such articles have been known for many years and have comprised the use of arms which are resiliently outwardly swung or slid, with the ends of the arms engaging opposite sides of the pocket confines to inhibit removal of the valuable from the pocket. The arms in these devices are manually retractable and retainable in a retracted position to permit ready withdrawal of the valuable from the pocket by the wearer. However, since manual compression of the arms on any portion of the arms will result in their retained, retracted position, a clever and dexterous thief could, in one motion, compress the arms to the retracted position and withdraw the valuable from the pocket undetected by the wearer. Also, the width of the confines of a pocket vary from garment to garment and extended arms of fixed given width, of the pocket, reduced the effectiveness against withdrawal.

SUMMARY OF THE INVENTION

A plate-like housing has formed therein an elongated channel which, when the housing is attached to a wallet or other valuable article, has its opposite open ends facing the side confines of a pocket or the like. A pair of slides are reciprocably movable in the channel with a slide extending from each open end of the channel and resiliently urged in extended positions. The end of each slide extending from the channel pivotally carries a wing which is pivotable outwardly from the housing to increase the transverse dimension measured across the slides from wing tip to wing tip. The tips are preferably coated with rubber, or other frictional material, to enhance gripping between the tips and the pocket confines and an outward camming action against the pocket confines to inhibit withdrawal of the article from the pocket when the slides are in their extended position.

Also, the slides at each end have a convex surface against which a portion of the wings may be manually urged by a compressive manual force against a predetermined segment of the wing opposite such convex surface. Force on the predetermined segment will cause the wing to act against the convex surface forcing the slide inwardly an additional increment sufficient to cause a releasable latching of the slide in the inward position. However, pressure against the wing at any segment other than the predetermined segment will not urge the slide inwardly the additional increment required for latching, and therefore upon release of manual pressure from the wings, the slides will be resiliently urged outwardly. Since only the wearer knows which segment of the wing is the predetermined segment to cause latching of the slides in their inward position, article removal by a thief is additionally thwarted.

Further, the wing may be provided with a Y-shaped slot in which a slide mounted pin rides to permit outward pivoting of the wing in both rotative directions so that even if the article is placed in the pocket in an inverted position, there will still be an inhibiting camming action of a wing tip on each of the pocket sides during any attempted withdrawal. Further, the plate housing may be inverted on the wallet, or other valuable article, thus placing the predetermined segment in a different position relative the wing edge as inserted in the pocket to further dicourage withdrawal attempts from the pocket. A construction is provided that is relatively inexpensive of manufacture and sturdy in construction, and is thinly dimensioned for convenience in use.

Therefore, it is an object of this invention to provide a device for safeguarding a wallet, or other valuable article from loss or withdrawal from a pocket or the like, which has superior safeguarding features.

Another object of this invention is to provide in the device of the previous object having an adjustably extensible dimension in a direction transverse to the withdrawal direction to further inhibit the article withdrawal from the pocket.

Another object of this invention is to provide in the devices of the previous objects a thinly dimensioned plate-like housing which is adaptable for attachment to a wallet or the like without noticeably increasing the wallet thickness.

Another object of this invention is to provide a device of the previous objects that is relatively sturdy and inexpensive of manufacture. The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is an elevational view of a preferred embodiment of this invention attached to a wallet inserted in a pocket with the slide arms in the latched retracted position; and with the slide arms in extended position shown in dashed lines;

FIG. 2. is an elevational view similar to that of FIG. 1 wherein the slide arms are in a extended position and the wing tips are engaging the side confines of the pocket in an outward camming position inhibiting withdrawal of the article from the pocket;

FIG. 3 is an enlarged view of a preferred embodiment of this invention having the cover plate removed and showing one slide arm in the extended position and its wing pivoted outwardly, and the other slide arm latched in its retracted position with the wing in a upright position;

FIG. 3*a* is a partial top plan view taken at 3*a*—3*a* of FIG. 3;

FIG. 4 is a partial view of the embodiment of FIG. 3 of the slide and wing, with the wing in an upright position, and the slide in an unlatched condition;

FIG. 5 is a view similar to FIG. 4, with the wing tilted inwardly against the convex slide surface and with the slide shown in the latched position;

FIG. 6 is a partial view of the slide and wing of another embodiment of this invention wherein the slide may be latched by manual force applied to any wing segment;

FIG. 7 is a partial view of a slide and wing, of a further embodiment, wherein the wing can pivot outwardly in either direction to engage the pocket confines;

FIG. 8 is a view of the embodiment of FIG. 7 showing the wing pivoted in a clockwise direction;

FIG. 9 is a partial view of the embodiment of FIGS. 7 and 8 with the wing shown pivoted in a counterclockwise direction.

FIG. 10 is an enlarged, partial view of the catch shown in two sequences in latching.

FIG. 11 is an enlarged partial view showing the catch in two sequences in unlatching.

DESCRIPTION OF THE PREFERRED EMBODIMENTS

Referring to FIGS. 1 and 2, a wallet 20 is shown inserted in a pocket 22 in a garment 24, such as a pair of trousers, the pocket 22 confines having side seams 26 and 28. Wallet 20 has attached thereto a protective device 30, which may be sewn or otherwise attached to a wallet cover and concealed by a wallet material, with protective device 30 shown in FIG. 1 in its retracted position wherein it does not offer resistence to wallet 20 removal from pocket 22, and is shown in its extended position in dashed lines prior to any withdrawal attempt. In FIG. 2, on a withdrawal attempt, the slide ends cammingly engage sides 26, 28 of pocket 22 causing sustantial wadding of the pocket sides to inhibit wallet 20 removal from pocket 22.

Referring to FIG. 3, device 30 has a plate-like housing 32 which has a back plate 34 and planar cover plate 36 attached thereto, as by pins with expansible heads, adhesive, or other conventional fastening members or materials. Housing 32 has formed therein a planar cylinder channel 38 and an elongated groove 40 having ends 42, 44 which act as limits, as later described. Groove 40 extends along an intermediate portion of the upper edge of channel 38. Channel 38 has wall 46 to which is attached a vertical arm 48 having indents 50, 52 formed near the upper end thereof for receiving ends of compression coil springs 54, 56 respectively. Guide legs 58, 60, also are attached to surface 46 and extend oppositely in a horizontal direction from arm 48.

Planar piston slide 62 is reciprocably movable in cylinder channel 38, has a nib 64 which is ridable in groove 40 and abuttable with end 42 to limit its extended position, shown in FIG. 3, and has an elongated slot 66 for receiving the other end of spring 54. Slide 62 has formed centrally thereof an elongated slot 68 for receiving leg 58 to guide slide 62. A notch 70 is formed at the lower corner of slide 62 and is provided with latch surface 72 for retaining slide 62 in inward latched position, as will be described. Slide 62 has a stop 74 formed on an upper corner thereof and has horizontally aligned pins 76 protruding from both sides thereof in opposite directions.

A wing 80 has an elongated groove 82 formed therein which is defined by surface 84 and sides 86, 88, each of which has a slot 92 formed intermediately thereof in which ride pins 76. Sides 86, 88 have edges 87, 89 formed thereon respectively. Wing 80 thus has a lost motion pivotal connection to slide 62 and is shown in its outwardly cammed position with surface 84 engaged with oblique slide stop surface 78 formed at the lower corner of slide 62.

Wing 80 has a rounded tip 90, which preferably is rubber coated, or coated with some other frictional material, and is engageable with side seam 26, FIG. 2, camming wing 80 outwardly to wedge it against side seam 26, to inhibit with increasing force withdrawal of wallet 20 from pocket 22, since the outward camming of wing 80 increases the dimension of slide 62 transversely to the withdrawal direction, arrow 93. Wing 80 has a concave notch 94 formed at the lower-outer corner thereof, for the purposes later described. In the opposite corner, at the lower end of wing 80, a smaller concave notch 96 which abuts convex surface 98 of plate 34 to pivot wing 80 to an upright position upon inward, or rightward, movement of slide 62. Slide 62*a*, which is a mirror image of slide 62, is shown in the inward latched position. Slide 62*a* has corresponding parts to slide 62 which are numbered similarly but with the suffix "a" after each reference numeral.

A wedge-shaped catch 100 is vertically reciprocable in cavity 101 formed in plate 34 and has cam surfaces 102, 104 on either side thereof, an elongated notch 106 formed in the upper surface thereof with latch surfaces 108, 110 formed at either end thereof, and a notch 112 formed in the lower surface thereof for receiving one end of leaf spring 114, the other end being anchored to plate 34. In this manner, catch 100 is resiliently and upwardly urged.

Slide release bars 120, 120*a* are reciprocably movable in slide slots 122, 122*a*, respectively, which are formed in plate 34. Bars 120, 120*a* have travel limit nibs 124, 124*a* respectively extending from the lower surfaces thereof which ride in travel limit slots 126, 126*a*, respectively, also formed in plate 34. Bars 120, 120*a* have finger engaging ends 128, 128*a* at their respective outer ends and oblique cam surfaces 130, 130*a* which are engageable against and operable on surfaces 102, 104, respectively, to urge catch 100 downwardly against spring 114 as bars 120, 120*a* are manually urged inwardly toward the center of plate 34, causing slides 62, 62*a* to be released since latched surfaces 72, 108 and 72*a*, 110 will become disengaged upon sufficient downward movement of catch 100. Upon unlatching, springs 54, 56 will operate against slides 62, 62*a* respectively, urging them outwardly to the position shown in FIG. 2.

An important advantage of the embodiment thus described is that manual force must be applied to a predetermined segment of the wings before the slides will become latched in an inward position, FIG. 1, to permit ready withdrawal from the pocket. To explain this feature of the invention, reference will be made to FIGS. 4 and 5. Wing 80*a*, which is similar in construction and operation to wing 80 and has corresponding parts which are designed by similar reference numerals followed by the suffix "a". When manual force is applied to a lateral segment of the edge 136 of wing 80*a* at a position indicated by arrow 138, the edge of slot 92*a* will abut pin 76 limiting further leftward transverse movement of wing 80*a*, and hence slide 62*a*, leaving movement of slide 62*a* an increment short of latching surfaces 72*a* and 110, of slide 62*a* and catch 100 respectively. Therefore, a manual force at a vertical or lateral position indicated by arrow 138 will not cause a latching between surfaces 72*a* and 110 so that upon release of the manual force, slide 62*a* will be resiliently returned outwardly in its extended position, inhibiting removal of wallet 20 from pocket 22.

However, when the manual force is at a position on a predetermined lateral segment of surface 136a, shown by arrow 140, in FIG. 5, wing 80a will be caused to shift rightwardly due to movement of slot 92a sliding over pin 76a and wing 80a pivoting counterclockwise about pivot 76a. The upper portion of edges 87, 89 will act against convex surfaces 142 of plate 34, and surface 84a will act against stop 74a of slide 62a forcing it inwardly the additional increment to cause latching between surfaces 72a and 110 which is accompanied by an audible click due to popping of catch 100 into notches 70, 70a of slides 62, 62a respectively. Thus, manual force along line 140 on either side of the wings 80, 80a will result in inward latching of slides 62, 62a, permitting easy withdrawal of wallet 20 from pocket 22. Removal of wallet 20 from pocket 22 can be thwarted unless one knows which predetermined segment of surface 136, 136a on wings 80, 80a, respectively, to apply a manual compressive force to cause latching of slides 62, 62a. Manual force applied to segments of surfaces 136, 136a other than the predetermined segment will not latch slides 62, 62a and the slides 62, 62a will be resiliently returned to their extended positions by springs 54, 56, thus inhibiting withdrawal of the valuable article from the pocket. Upon slides 62, 62a moving to their latched positions catch 100 will be forced downwardly, thus "cocking" or forcing bars 120, 120a to their outward positions.

Once slides 62, 62a are in their inward latched position, and the article has been reinserted in the pocket, they may be readily released by pressing on ends 128, 128a of bars 120, 120a, respectively, causing inward movement thereof and engagement between cam surfaces 130, 130a, respectively, with cam surfaces 102 and 104 of catch 100, forcing catch 100 downwardly and releasing the latching surfaces permitting resilient return of slide 62, 62a to their extended position under the force of springs 54 and 56. Referring to FIG. 6, an embodiment is shown wherein manual force along any segment of surface 81 of slide 80b will cause slide 62b to be latched in an inward position. In this embodiment, wing 80b is pivotally mounted to slide 62b about pin 76b, which is affixed to and extends from slide 62b, and upon manual force from the rightward direction, as shown by arrow 83, slide 62b will be forced leftwardly a sufficient distance to cause surface 73b to engage catch surface 104, forcing catch 100 downwardly against its spring force, to cause a latching between surfaces 110 and 72b to hold slide 62b in its inwardly releasable latched position. It is seen that manual force applied to any vertical segment of surface 81 will cause the required inward movement of slide 62b to latch 62b in the inward position before wing surfaces 96b and 97b engage corresponding surfaces of plate 34. It is to be understood that in the disclosed embodiments, the slide and wings are symmetrical about a vertical centerline through device 30, but, for particular purposes, the wings and associated slide surfaces on one side of device 30 may be varied as desired from the wing and slide surfaces on the other side of device 30.

Referring to FIGS. 7 to 9, another alternate embodiment similar to the previous embodiments except that wing 80c can pivot both clockwise and counterclockwise in arcs of approximately equal lengths. A Y-shaped slot is formed in piston slide 62c and has a slot arm 142 having pivot aperature 144 at the end thereof, and a slot arm 146, having converging sides, has a pivot aperture 148 at the end thereof. Thus, a clockwise rotative force applied to wing 80c about pivot pin 76c, affixed to wing 80c, will cause pin 76c to ride the walls of slot 142, until pivot aperture 144 engages pin 76c, position shown in FIG. 8. Conversely, when a counterclockwise rotative force is applied to wing 80c, it is caused to pivot in a counterclockwise direction, pin 76c riding the walls of slot 146 until it reaches pivot aperture 148, wherein the counterclockwise pivoting is continued until surface 84c abuts stop 85 formed on slide 62c as shown in FIG. 9. Preferably, corner 87 has a rubber, or other frictional material coating, to aid in counterclockwise camming action of wing 80c as it engages a pocket seam 28, which would occur on a pocket withdrawal if the device were inverted on pocket insertion. On counterclockwise rotation, wing 80c operates in a manner similiar to that in the operation of wing 80a in the latching when a force is applied to the predetermined segment in the area of arrow 152 but will not latch when the force is applied to lower predetermined segments on wing 80c.

Thus, wing 80c can pivot in approximately equal arcs in both the counterclockwise and clockwise directions so that the wallet may be inserted in an inverted position in pocket 22 and the outward camming action previously described will take place upon attempted withdrawal of wallet 20 from pocket 22. Also, with this embodiment, plate 34 may be placed in inverted position in the wallet cover and the outward camming action will still be achieved. By inverting plate 34, whether by inverting the position of wallet 20 in pocket 22 or inverting the position of plate 34 in the wallet cover itself, the position of release pressure 140 will also be inverted, so that any attempted withdrawal of the valuable article from the pocket by one unfamiliar with the manner in which the article has been inserted in the pocket, or in which the plate 34 is oriented in the article, will be additionally difficult. Therefore a device is provided where the release pressure 140 may be at the upper segment of surface 136 or the lower segment of surface 136, depending on whether or not the device is inverted in the pocket. The materials of the components of device 30 may be manufactured of molded plastic and housing 32 is thinly dimensioned yet sturdily constructed. The piston slides, which bear a primary load in operation of the device, are sturdily constructed even though thinly dimensioned due to their vertical dimension.

Referring to FIG. 10, the latching operation of slides 62 and 62a will be more fully described. Surface 73 is formed of surfaces 73', 73'' having different inclinations which sequentially engage cam surface 102 on inward movement of slide 62. Upon inward latching movement of slide 62, surface 73' initially engages cam surface 102 on catch 100, causing catch 100 to move rightwardly and pivot clockwise towards the dashed position shown in the drawing. Continued inward movement of slide 62 causes cam surface 102 to slide downwardly to engage surface 73'', as shown in the dashed position of catch 100 in FIG. 10. At this point, the cam surface 104 on catch 100 has been displaced sufficiently downwardly so that slide 62a can be moved fully inwardly to its latched position without contact between surfaces 73a and 104. The clockwise pivoting of catch 100 results from one end of spring 114 being anchored in the left lower corner of housing 34 defining space 101, which is closer to slide 62 than slide 62a, and the fact that the opposite end of spring 114 is securely fastened in notch 112 of catch 110.

Because inward movement of slide 62 not only compresses spring 54 but also is pivoting catch 100 rightwardly and downwardly, and since inward movement of slide 62a need only overcome the force of spring 56, slide 62a will reach its inwardmost position before slide 62 reaches its inwardmost position. Thus, when slide 62 moves another increment inwardly from that shown in the dashed position in FIG. 10, latching contact will take place between surfaces 72 and 108 on catch 100, with spring 114 forcing catch 100 in rapid counterclockwise rotation so that surface 110 will "snap" into notch 70a, causing an audible click signifying to the wearer that the slides 62, 62a are in their inwardly latched position and the wallet may be withdrawn from the pocket. Due to the fact that slide 62a reaches its inwardmost position prior to slide 62 reaching its inwardmost position, and due to the fact that the audible click occurs after slide 62a reaches its inwardmost position, a very high reliability of both slides 62 and 62a being latched is obtained. Also, because of the counterclockwise rotation of catch 100 snapping into latched position, a relatively loud click is obtained which would alert the wearer to any unauthorized attempt to remove the wallet from the pocket.

Referring to FIG. 11, release movement of slides 62, 62a is shown with slide bars 120, 120a shown initially engaging cam surfaces 102, 104 of catch 100 and upon simultaneous inward movement, cause a substantially vertical lowering of catch 100 against the resilience of spring 114 to the dashed position. In the dashed position, the latch surfaces of catch 100 have sufficiently been lowered to release slides 62, 62a causing the springs 54, 56 to extend the slides 62, 62a respectively, to their outermost positions.

Referring to FIG. 3, it is noted that stops 74, 74a may be placed in various vertical positions along the respective end surfaces of slide 62, 62a resulting in a corresponding change in the predetermined segment on wings 80, 80a which must be pressed in order to effect the final increment of inward latching motion to cause the aforedescribed movement of catch 110 into its ultimate latch position.

While there have been described above the principles of this invention in connection with specific apparatus, it is to be clearly understood that this description is made only by way of example and not as a limitation to the scope of the invention.

What is claimed is:

1. Apparatus for releasably retaining articles in pockets and the like comprising:

a housing;

a channel being formed in said housing in a direction substantially transverse to the direction of article withdrawal from the pocket;

at least one slide having a first end having a predetermined lateral segment and remaining lateral segments and being reciprocably movable in said channel between an inward position wherein said slide is positioned substantially within said channel and an extended position wherein said first end is extending substantially without said channel in pocket side engageable position;

first means for resiliently urging said slide to said extended position;

second means for releasably retaining said slide in said inward position upon a predetermined inward movement from said extended position;

third means for obtaining said releasable retention upon said predetermined inward movement when manual force is selectively applied to a predetermined lateral segment of said first end of said slide but for selectively preventing said predetermined inward movement when manual force is applied to any of the remaining lateral segments of said first end of said slide.

2. The apparatus of claim 1 wherein said third means comprises a first wing having a lost motion pivotal connection to said slide end so that manual force selectively applied to said predetermined segment on said first wing will cause said wing to pivot in a first direction inwardly toward said housing;

said wing having a portion cooperable with a respective slide end to move said slide an additional increment inwardly to releasably retain said slide in said inward position, but manual force on the remaining segments will not cause said pivoting and movement of said slide said additional increment.

3. The apparatus of claim 2 including fourth means for providing pivoting of said wing in a second direction opposite to said first direction for engaging a first wing corner with a pocket side when said slide is in said extended position.

4. The apparatus of claim 2 including:

fourth means for providing pivoting of said wing in a second direction opposite to said first direction for engaging a first wing corner with a pocket side when said slide is in said extended position and for pivoting in said first direction for engaging a second wing corner with a pocket side when said slide is in said extended position.

5. The apparatus of claim 4 wherein said fourth means comprises a Y-shaped slot formed in said wing having a first slot arm and a pin on said slide ridable in said slot;

a first pivot aperture being at one end of said slot arm;

a second slot arm formed in said wing and obliquely extending from one side of said first slot arm and having sides converging from said one side to a second pivot aperture;

whereby pivoting of said wing in said first direction causes said pin to ride in said second slot arm to said first aperture and pivoting of said wing in said first direction causing said pin to ride in said second slot arm towards said second aperture.

6. The apparatus of claim 1 including a second slide reciprocably movable in said channel between an inward position wherein said second slide having an end with a predetermined lateral segment and remaining lateral segments is positioned substantially within said channel and an extended position wherein said second slide end is extending substantially without said channel in a direction opposite to the extended direction of said one slide in engageable position with an opposite pocket side:

said second means for releasably retaining said second slide in said inward position upon a predetermined inward and movement from said extended position;

fourth means for obtaining said releasable retention of said second slide upon said predetermined inward movement when manual force is selectively applied to a predetermined lateral segment of said end of said second slide but for selectively preventing said predetermined inward movement of said second slide when manual force is applied to any of the remaining lateral segments of said end of said second slide.

7. Apparatus for releasably retaining articles in pockets and the like comprising:

a plate;

a channel being formed in said plate in a direction substantially transverse to the direction of article withdrawal from the pocket;

at least one slide having an end and being reciprocably movable in said channel between an inward position wherein said slide is positioned substantially within said channel and an extended position wherein said slide is positioned substantially without said channel and said end is positioned externally of said channel;

first means for retaining said slide in said inward position upon a predetermined inward movement from said extended position;

second means connected to said slide end for cammingly increasing the slide dimension after the slide has reached its most extended position in the transverse direction to engage the pocket confines upon attempted withdrawal of the article from the pocket and upon slide end contact with the pocket confines.

8. The apparatus of claim 7 wherein said second means comprises a wing pivotally mounted to the end of said slide and swingable in a first arcuate direction outwardly upon withdrawal movement of the article from the pocket to cammingly expand against a side seam of said pocket and restrict article withdrawal therefrom;

whereby said wing cammingly increases the slide dimension in the transverse direction against the confines of the pocket upon movement of the article in the withdrawal direction upon slide end contact with the pocket confines.

9. The apparatus of claim 1 including a Y-shaped slot formed in said wing having a first slot arm and a pin on said slide ridable in said slot;

a first pivot aperture being at one end of said slot arm;

a second slot arm formed in said wing and obliquely extending from one side of said first slot arm and having sides converging from said one side to a second pivot aperture;

whereby pivoting of said wing in a second arcuate direction opposite to said first direction causes said pin to ride in said second slot arm to said first aperture and pivoting of said wing in said second direction causing said pin to ride in said second slot arm towards said second aperture.

10. Apparatus for releasably retaining articles in pockets and the like comprising:

a housing;

a channel being formed in said housing in a direction substantially transverse to the direction of article withdrawal from the pocket;

first and second slides each reciprocably movable in said channel between an inwardmost position wherein each slide is positioned substantially within said channel and an extended position wherein each slide has a substantial portion extending without said channel in pocket side engageable position;

first means for resiliently urging said slides to said extended position;

second means for releasably retaining said slides in said inward position in sequence, said first slide being retained firstly and said second slide being retained secondly upon a predetermined inward movement of said slides from extended position;

said second means comprising a movable catch which is resiliently and arcuately movable in one direction by engagement of said first slide with said catch during inward movement of said first slide and in the arcuately moved position providing clearance for the inwardmost movement of said second slide whereby said second slide reaches its inwardmost position prior to the time when said first slide reaches its inwardmost position;

said catch being arcuately movable in the opposite direction to said one direction when said first slide reaches its inwardmost position to snap said catch into latching position for said first and said second slides.

11. The apparatus of claim 10 wherein said second means comprises a spring member having one end anchored in said housing at an anchor point closer to said first slide than said second slide and the other end of said spring member attached centrally to said catch so that contact by said first slide with said catch will cause said arcuate movement of said catch about said one end of said spring member.

* * * * *